United States Patent [19]

Bochan

[11] 3,958,433

[45] May 25, 1976

[54] WASH BASKET FOR A WASHING MACHINE

[75] Inventor: John Bochan, Louisville, Ky.

[73] Assignee: General Electric Company, Louisville, Ky.

[22] Filed: June 20, 1974

[21] Appl. No.: 481,209

[52] U.S. Cl. ..... 68/23.3; 68/133; 68/208; 210/359; 210/445; 233/2; 233/46

[51] Int. Cl.[2] ..... D06F 23/04; D06F 39/08

[58] Field of Search ..... 68/132, 133, 148, 154, 68/174, 195, 208, 23.3, 172, 53, 23.2, 181 R, 23, 232, 23.5; 233/2, 27, 28, 46; 210/359, 445

[56] References Cited

UNITED STATES PATENTS

| | | | |
|---|---|---|---|
| 2,003,642 | 6/1935 | Brunn | 68/208 X |
| 2,021,097 | 11/1935 | Maus | 68/133 |
| 2,380,872 | 7/1945 | Rocke | 68/154 X |
| 2,615,320 | 10/1952 | Belaieff | 68/23 X |
| 2,648,964 | 8/1953 | Graham | 68/174 |
| 2,662,536 | 12/1953 | Martiniak et al. | 68/208 X |
| 2,969,172 | 1/1961 | Hutt | 68/23.2 X |
| 3,493,118 | 2/1970 | Brucken | 68/23 X |

FOREIGN PATENTS OR APPLICATIONS

| | | | |
|---|---|---|---|
| 801,933 | 1/1951 | Germany | 68/132 |

*Primary Examiner*—Peter Feldman
*Assistant Examiner*—Philip R. Coe
*Attorney, Agent, or Firm*—Frederick P. Weidner; Francis H. Boos

[57] ABSTRACT

A combination tub-wash basket for a vertical axis washing machine is an imperforate structure formed generally in the shape of a frustum of a cone mounted upon a concave base portion so as to provide an enlarged annulus chamber around the bottom of the basket. A perforate divider member is secured within the basket and is formed to provide an annular depression so as to define in the basket a clothes retaining area and a lower, washing medium retaining area. This perforate divider member is provided with vanes for imparting washing action to the clothes and a coaxial shaft for preventing large items being washed from lying across the basket. The base of the basket is provided with an axially concentric drain. When the wash basket is mounted within a machine providing a shifting nodal point, gyratory suspension system, during the centrifugal water extraction process, the annulus chamber provided at the bottom of the basket will contain water which, postcritically, will position itself therein to counter any unbalance in the basket resulting, for example, from the bunching of clothes.

6 Claims, 1 Drawing Figure

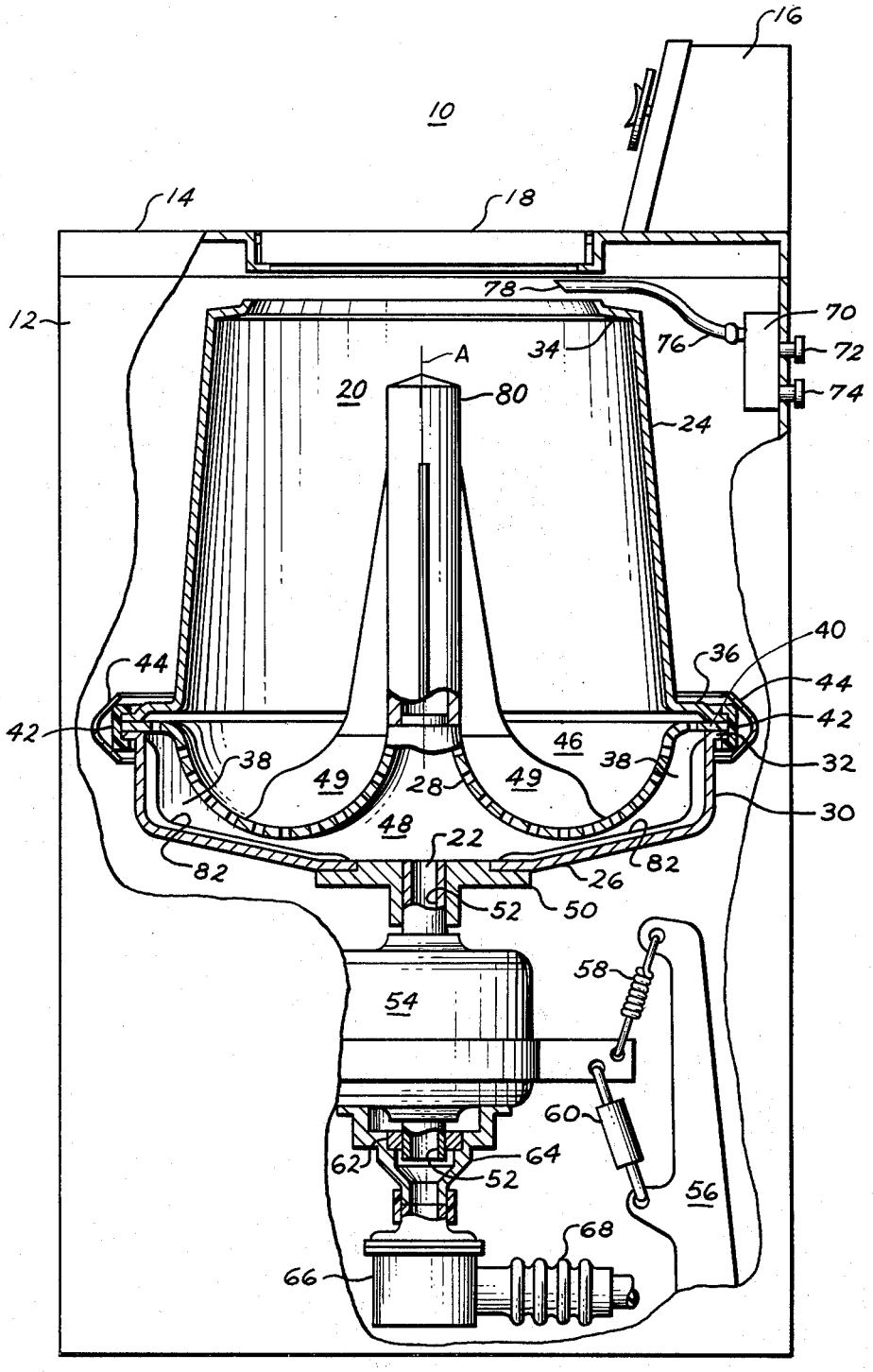
16
10
14
18
78
12
70
76
72
34
A
74
20
80
24
40
36
44
44
42
42
46
38
38
32
49
28
49
30
48
22
82
26
82
52
50
58
54
60
62
64
52
56
68
66

WASH BASKET FOR A WASHING MACHINE

BACKGROUND OF THE INVENTION

1. Field of the Invention:

The present invention relates to a wash basket for a washing machine and more particularly to a combination tub-wash basket having imperforate outer walls and a central coaxial drain in the base thereof for use in a clothers washing machine of the vertical axis type.

2. Description of the Prior Art:

Conventional clothes washing machines of the vertical axis, agitator type are traditionally rather large and complex. Generally there is provided a cabinet enclosing an outer, water-retaining tub within which is situated a clothes retaining basket, usually having perforate walls. An agitator is mounted within this inner basket and the basket-agitator assembly is coupled through a suitable power transmission with an electric motor for rotational and oscillatory motion. Such machines are as a result, inherently rather expensive and consume large amounts of water.

It is desirable to provide a wash basket for a washing maching which can handle a typical washing load but which combines the functions of retaining the clothes being washed and the washing medium, usually water and some sort of a detergent. It is further desirable to provide such a combination tub-wash basket which is capable of being rotated about its concentric vertical axis for the removal of water from clothes during a centrifugal extraction process and which is further lightweight in construction but durable and which is provided with means for automatically balancing out any unbalance resulting from oscillatory or rotational movement of the basket. It is further desirable to provide such a combination tub-wash basket having a drain situated about the concentric vertical axis on the base portion of the wash basket.

By the present invention, there is provided such a combination tub-wash basket having outer, imperforate walls and a drain situated on the base about the concentric vertical axis and which is provided with means for balancing out any unbalance resulting during the centrifugal water extraction process. Such a wash basket as provided by the present invention is rather simple of construction, reliable and of fairly low cost and as a result of its design aids in reducing the water consumption for a typical washing and rinsing operation.

SUMMARY OF THE INVENTION

In accordance with the present invention, there is provided in a washing machine of the vertical axis type, a combination tub-wash basket rotatable about a concentric vertical axis for receiving both items to be washed and a washing medium. The wash basket includes a generally circular, imperforate, concave base having a drain opening at the center thereof and further includes a generally cylindrical, imperforate side wall portion. A perforate divider member is provided secured within the basket to provide an upper, item retaining area and a lower, washing medium retaining and draining area.

BRIEF DESCRIPTION OF THE DRAWINGS

The accompanying drawing is a side elevational view of a domestic clothes washing machine broken away to show a preferred embodiment of the wash basket of the present invention, the view being partly in sectiion.

DESCRIPTION OF THE PREFERRED EMBODIMENT

Referring to the drawing, there is shown a washing machine 10 of the vertical axis type which includes a cabinet 12 having a top 14. Cabinet top 14 includes a control panel 16 normally provided with a plurality of switches and controls necessary for the operation of the machine and which are normally coupled into the electrical circuitry thereof (not here shown). Cabinet top 14 is also provided with an access lid 18 normally hinged (not shown) for movement between a closed position as shown and an open position for gaining access into the machine for the placement therein of clothes to be washed.

In accordance with the present invention, there is provided a combination tub-wash basket 20 arranged within washing machine 10 for oscillatory motion and concentric rotation about its vertical axis, designated as A in the drawing. Wash basket 20 will receive both items such as clothes to be washed and the washing medium and may take the general shape of a cylinder having a closed, somewhat concave base, the outer walls being imperforate except for a single opening 22 provided coaxially in the base thereof to serve as a drain for the washing medium.

In the preferred embodiment, wash basket 20 has been formed of three major components, namely: A side wall portion 24, a base portion 26 and a perforate divider member 28. The base 26 is generally circular as viewed in top plan and is concave such that the washing medium, for example water and perhaps detergent, may gravitate from the side walls inwardly toward the center drain opening 22. The concave base portion is provided with an annularly upturned edge 30 which is in turn provided with an annularly out-turned flange 32. Base 26 may be formed of metal and takes the general shape of a bowl having a somewhat concave base or bottom portion. Side wall portion 24, which may be of generally cylindrical shape, is, in the preferred embodiment, shown in the form of a frustum of a cone having a top diameter smaller than the base diameter. This serves to hinder and generally prevent the traveling of water up the side wall during a centrifugal extraction process, wherein the wash basket spins, i.e., is rotated at a high velocity about its vertical axis. Side wall portion 24 is provided with an in-turned annular flange 34 which defines an opening into the wash basket and which further serves to prevent water and clothes from passing out of the basket during the high speed spinning process. Side wall portion 24 is also provided with an out-turned annular flange 36 for mating with flange 32 of the base portion thereby to define the wash basket.

It can be readily seen that an annulus chamber 38 is formed around the base of the wash basket 20 resulting from the enlargement of the diameter of the base portion and the upturned edge 30 mating with side wall portion 24. Perforate divider 28 then is provided with an annularly out-turned flange 40 arranged for seating between flanges 32 and 36. A water seal gasket 42 is placed in mating engagement with the assembled portions of the wash basket around the periphery of the three mating flanges 32, 36 and 40 and a clamp member 44 is placed thereover and is secured tightly so as to provide a single piece, water-tight wash basket.

Perforate divider 28 has been provided in the shape generally of an annular depression to provide an upper clothes retaining area 46 and a lower water-retaining and draining area 48 which includes annular chamber 38. A plurality of radial or helical vanes 49 are provided molded into divider 28 for imparting washing action to items being washed. In manufacture, base 26, side wall 24 and perforate divider 28 may be molded and from any suitable material such as polypropylene. An annular, flanged support member 50 is provided as a portion of the base to provide rigidity and strength to the wash basket 20. Support member 50 then is suitably secured to base 26 in a water-tight fashion.

As has been mentioned, wash basket 20 is mounted for oscillation and rotation about its concentric vertical axis. To this end, a tubular shaft 52 is provided rigidly secured to support member 50 and thence to a motor-drive system 54. This whole assembly then forms a dynamic system which is mounted within cabinet 12 upon a shifting nodal point, gyratory suspension system. This suspension system includes a plurality of vertical support members 56 (only one of which is shown) suitably secured rigidly to the cabinet 12. Included also are a plurality of suspension springs 58 (only one of which is shown) serving to suspend the motor drive system 54 and the wash basket 20 from support members 56 and a plurality of damping means such as spring loaded, frictional dampers 60 (only one of which is shown) serving to dampen vibration resulting from rotational and oscillatory motion of the dynamic system. A rotary seal 62 is provided for preventing water draining from wash basket 20 through tubular shaft 52 from backing up into the motor-drive system 54. A base housing 64 is provided secured to motor-drive system 54 and serves to couple the tubular shaft 52 to a suitable drain system through a pump 66 and a flexible hose 68.

Means are provided for coupling to a source of hot and cold water respectively (such as the home water faucets) in the form of a solenoid operated valve 70 having inlets 72 and 74 for coupling respectively to cold and hot water. Solenoid operated valve system 70 is in essence a water mixing valve and is operable in response to settings made upon control panel 16 and is coupled by a hose 76 to nozzle 78 communicating with combination, tub-wash basket 20 for supplying the necessary water thereto for effecting wash and rinse operations.

In operation, in a wash basket as shown provided with an agitator like member 80 rigidly secured within the basket to perforate divider 28, during a wash portion of a cycle, clothes to be washed and any detergent necessary are placed within the basket and the various controls on control panel 16 are arranged to provide the desired washing operation. Upon setting the machine into operation, water will proceed to flow from nozzle 78 into the wash baseket until reaching a predetermined level therein. For such an operation motor-drive system 54 may be provided for example with means for effecting oscillatory motion of basket 20 thereby to effect a washing action upon the clothes placed therein. Upon the completion of the allotted time for the washing operation, pump 66 will be activated and the water and detergents will be drained from the machine, the water passing from the basket through tubular shaft 52. A rinse cycle would be accomplished in the same way as the wash cycle but omitting the detergent.

Upon the completion of the rinsing and washing portions of the cycle, the motor-drive system 54 would be switched to provide rotational movement to wash basket 20 to effect a centrifugal water extraction spin process. With such a machine, the first resonant or critical frequency thereof is designed to be low enough such that the machine will pass through this frequency with very little water being extracted from the clothes by centrifugal force. Post critically then as the wash basket begins to rotate at a higher velocity, water being extracted from the clothes will proceed to the annulus chamber 28 wherein it will stay for the duration of the centrifugal extraction process. When the rotation of basket 20 ceases, the water in annular chamber 28 will gravitate toward drain opening 22 to flow then out of the machine.

Oftentimes however, unbalance results in the dynamic system due to clothing in the basket being bunched or gathered on one side thereof. In such a situation, the water positioned in the annulus chamber 28 will tend to position itself therein opposite the unbalance serving in essence as a balancing means in the rotating system. This is so because, post critically, the spinning system will try to run about a new center of gravity as created by the unbalance and the light side will lean out. Thus, a balancing force will be created tending to make the basket run more smoothly with heavier unbalances.

In practice, it has been found that the annulus chamber 38 is at times not large enough to contain all the water removed from items being washed. The spin operation therefore may be divided into three portions, with a slight pause after each of the first two portions and with the pump 66 activated to allow water to drain out of the machine. The third portion of the spin operation is a long one and in fact the only one wherein the basket gets up to full spin. It is during this portion of the spin operation that the balancing effect heretofore described is effected and is indeed necessary.

To prevent surging of water in the base of the basket 20, especially as the basket is rotated a plurality of radial fins 82 are provided secured to the concave base 26. Such radial damping fins may be molded into the base 26 to further serve as rigidizers and strengthening ribs for the wash basket.

Of course such a combination tub-wash basket may be used in conjunction with a typical agitator type of washing machine wherein only the agitator oscillates while the wash basket remains relatively still, provided that means are provided for draining water from the basket as where the mechanism has an axial, hollow center shaft as provided herein. It can be also seen that such a combination tub-wash basket may be used in an environment wherein a fixed nodal point suspension system is provided but in such a case, there will be no post-critical water balancing provided by the wash basket.

It can be seen that the advantages of such a combination tub and wash basket are many and include: there is no recirculation pump to become plugged with clothes going over the side wall; the system is of low cost, as a complete outer water container is eliminated; in a machine as described herein, only one rotating water seal is necessary; water usage is kept at a minimum since there is no outer tub to be filled; lack of outer tub leaves more room for the spin excursion thereby to result in an overall smaller machine; and a degree of water balancing, post critically, with spin-out water is achieved.

It should be apparent to those skilled in the art that the embodiment described heretofore is considered to be the presently preferred form of this invention. In accordance with the Patent Statutes, changes may be made in the disclosed apparatus and the manner in which it is used without actually departing from the true spirit and scope of this invention.

What is claimed is:

1. In a vertical axis washing machine, a combination tub-wash basket for receiving both items to be washed and a washing medium, and means for alternatively providing oscillatory motion and rotatable motion of the basket continuously in one direction for successive revolutions about its vertical axis, said basket comprising:

a generally circular, imperforate, concave base having a drain opening at the center thereof;

a generally annular, upturned edge extending upwardly from said base;

a generally cylindrical, imperforate side wall portion located above said base and said edge;

a perforate divider member secured within the basket above the base and below said side wall to provide an upper, item-retaining area and a lower, washing medium retaining and draining area;

an annular chamber formed by said base, said edge, and said perforate divider member, said annular chamber being radially outward of the side wall portion and providing a passageway for the washing medium therearound whereby the washing liquid will position itself postcritically in the annular chamber opposite any unbalance weight caused by the items being washed; and a plurality of vanes within said upper itemretaining area for effecting washing action upon the items being washed during oscillatory motion of the basket.

2. The wash basket of Claim 1 wherein the wash basket is mounted upon a shifting nodal point, gyratory suspension system secured within the washing machine.

3. The wash basket of Claim 2 wherein a plurality of radial fins are provided on the inside of the annular chamber of the basket and secured to the concave base for effecting a damping anti-surge action upon the washing medium when the basket is rotated.

4. The wash basket of Claim 1 wherein the imperforate side wall portion has a slightly smaller diameter at the top than at the bottom for hindering the washing medium from traveling up the side wall when the basket is rotated.

5. The wash basket of Claim 1 wherein the top of the imperforate side wall has an annular, inturned flange to define an opening in the basket for the placement therein of items to be washed.

6. The wash basket of Claim 1 wherein the perforate divider member is formed to provide an annular depression within which items to be washed will gravitate, the divider being provided with a plurality of radial vanes extending into the upper item-retaining area for effecting washing action upon items being washed.

* * * * *